United States Patent [19]

Panunzi et al.

[11] Patent Number: 4,720,989

[45] Date of Patent: Jan. 26, 1988

[54] METHOD OF AND APPARATUS FOR ROLLING AN I-BEAM BLANK

[75] Inventors: Carlo Panunzi, Differdange; Henri Grober, Esch; Joseph Sbarra, Soleuvre; Albert Zenner, Differdance, all of Luxembourg

[73] Assignee: Arbed S.A., Luxembourg, Luxembourg

[21] Appl. No.: 874,224

[22] Filed: Jun. 13, 1986

[30] Foreign Application Priority Data

Jun. 13, 1985 [LU] Luxembourg ..... 85950

[51] Int. Cl.[4] ..... B21B 1/00

[52] U.S. Cl. ..... 72/221; 72/234

[58] Field of Search ..... 72/221, 225, 234, 366

[56] References Cited

U.S. PATENT DOCUMENTS 4,381,658 5/1983 Kugushin et al. ..... 72/234
4,420,961 12/1983 Kusaba et al. ..... 72/234
4,637,241 1/1987 Michaux ..... 72/234

FOREIGN PATENT DOCUMENTS 607321 3/1931 Fed. Rep. of Germany .

*Primary Examiner*—W. D. Bray
*Attorney, Agent, or Firm*—Karl F. Ross; Herbert Dubno

[57] ABSTRACT

An I-beam blank is rolled from a bloom by rolling into opposite edges of the bloom respective central triangular section notches of predetermined apex angle, apex radius of curvature, width, and height in a succession of roll passes. According to this invention the radius and apex angle of the notches are progressively increased a plurality of times during the succession of roll passes. Then the notches are pressed by rolling generally out of the bloom edges in at least one final rolling pass, thereby flattening these edges. The rolling passes are carried out between respective pairs of rolls having facing grooves bases and the roll pairs of the grooving steps are formed with respective triangular-section ridges complementary to the notches being formed. In addition the bloom is rolled repeatedly in the first pair of grooves until the material of the bloom flanking the notch mainly fills these grooves, that i until the bloom bottoms in the grooves.

3 Claims, 2 Drawing Figures

METHOD OF AND APPARATUS FOR ROLLING AN I-BEAM BLANK

FIELD OF THE INVENTION

The present invention relates to a method of and apparatus for preparing an intermediate product or blank from which an I-beam can be rolled. More particularly this invention concerns the production of an I-beam from a continuously cast bloom.

DESCRIPTION OF THE DRAWING

The instant invention and prior art will be described in more detail with reference to the accompanying drawing in FIG. 1 is an end view illustrating various blooms and a beam blank.

BACKGROUND OF THE INVENTION

It is known to produce a blank from a continuously cast bloom by forming each edge of the bloom with a longitudinal notch by hot rolling in grooves provided with central ridges at their bases. Further rolling steps follow without centrally forming the bloom in alternate breakdown and shaping passes.

A deep notch is formed in the face of the bloom and the flanks delimiting this notch are flattened by breakdown or upsetting passes so as to obtain the desired shape in accordance with German patent No. 607,321. This process, which is aimed mainly at the manufacture of rails, can be used for rolling beams by applying the deformation symmetrically to the two edges of an intermediate product of rectangular section so as to form the two flanges of the blank.

German patent document No. 3,220,666 describes a process wherein the narrow edges of a bloom are upset into the shape of a mushroom. The first groove of the rolls which do this upsetting are provided with two bumps which are used to center the bloom in the second groove where same is subjected to upsetting passes with free widening. This process is based essentially on a controlled widening of the edges of the bloom under the effect of more or less major upsetting passes.

It is also known from German patent document No. 3,222,930 to use several grooves provided with pointed ridges of a constant apex angle but of increasing height. Equally the width of the base of the grooves increases. The principle at the base of this process is to form in the edges of the bloom a notch of a given angle and of a depth equal to at least 40% of the width of the flange of the finished beam by using different grooves. The rolling is such that the ends of the flanks of the notch do not touch the bases of the grooves.

The disadvantage of these processes of the prior art is that the amount of deformation of the bloom that is transformed into lengthening is excessive. As a result the rolling of beams, having for example a web height of 1m and a flange width of 450mm, requires blooms having to start with a width greater than 2.1m. Thus it is not possible to roll blooms of this width in standard setups. Equally it is impossible to obtain great flange widths starting from certain web heights.

Figure 1:
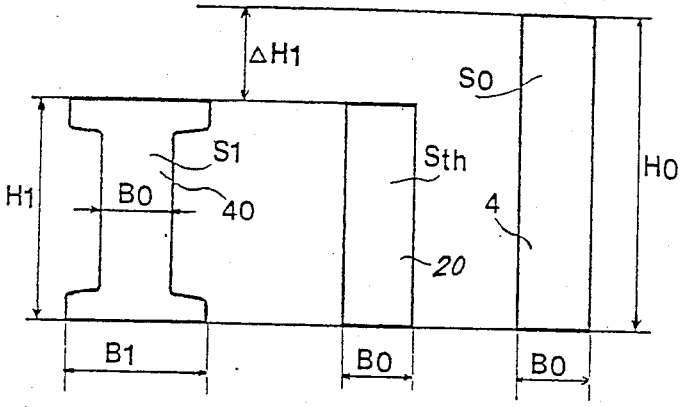

As seen in FIG. 1 of the drawing, assuming that H0 (height), B0 (width), So (section) characterize the starting bloom 4, that Hl, B0, Sl characterize the same dimensions in the blank 40, and that the section 20 is a blank which is rolled to a smaller section Sth but the same height Hl and width B0 as the I-beam blank 40, the efficiency of the process of rolling can be defined by the following considerations (see FIG. 1):

The height differential (H0−H1) corresponds to the total upsetting or shortening work done during the first phase in transforming the bloom 4 into the blank 40.

The spread ratio (E) equals B1/B0.

The theoretical lengthening (Lth) equals So/Sth and is the lengthening that exists in the fictitious case in the total absence of widening.

The real lengthening (Lr) equals S0/Sl.

The portion of deformation transformed into lengthening is given by:

$$Lr/Lth = Sth/Sl.$$

The portion of deformation transformed into widening is therefore:

$$(1 - Sth/Sl).$$

This is the factor that gives the efficiency of this type of rolling process.

OBJECTS OF THE INVENTION

It is therefore an object of the present invention to provide an improved method of and apparatus for rolling and I-beam blank.

Another object is the provision of such a method of and apparatus for rolling and I-beam blank which works with a high rate of efficiency so that it can roll such a blank from a thinner and narrower bloom than has hitherto been possible.

SUMMARY OF THE INVENTION

An I-beam blank is rolled from a bloom by rolling into opposite edges of the bloom respective central generally triangular-section notches of predetermined apex angle, apex radius of curvature, width, and height in a succession of roll passes. According to this invention the radius and apex angle of the notches are progressively increased a plurality of times during the succession of roll passes. Then the notches are pressed by rolling generally out of the bloom edges in at least one final rolling pass, thereby flattening these edges.

The efficiency of the process of rolling the blank bloom is given by the factor defined above 1 — Sth/Sl) which indicates how much of the deformation is actually widening. This factor reaches values of 0.35 for the process according to the invention against 0.18 to 0.24 for the prior-art processes. This makes it possible to roll radically dimensioned beams, for example it is possible to produce beams of a height of 1000mm and a flange width of 450mm starting with blooms 1990×300 or beams of a height of 570mm, a width of 450mm, and a flange thickness of up to 125mm.

According to another feature of this invention the rolling passes are carried out between respective pairs of rolls having facing grooves bases and the roll pairs of the grooving steps are formed with respective triangular-section ridges complementary to the notches being formed. In addition the bloom is rolled repeatedly in the first pair of grooves until the material of the bloom flanking the notch mainly fills these grooves, that until the bloom bottoms in the grooves.

In at least one of the subsequent, that is not the first, roll passes the steel of the bloom to each side of the notches is substantially unconfined and can spread laterally. This is achieved by providing the ridges for this pass are not provided in grooves but are project radially well beyond the rest of the respective rolls.

The apparatus for carrying out the method of this invention has at least one pair of rolls with each roll formed with a plurality of grooves all but one of which has a central ridge of the respective different radii and apex angles. The different ridges are of similar height and at least one ridge or raised part is not within a groove to allow free lateral spreading of the bloom to each side of the notches. The rolls of this invention are horizontal and are part of a double reversible roll stand.

SPECIFIC DESCRIPTION

Figure 2:
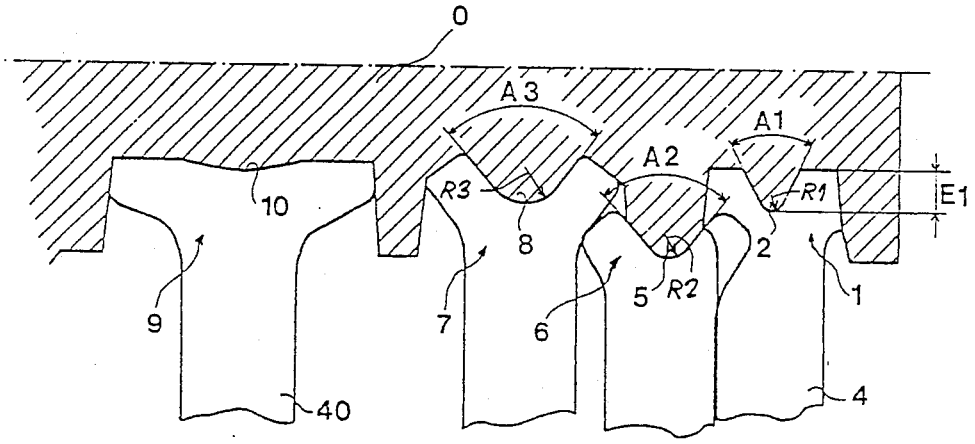
FIG. 2 is a detail of a roll for carrying out the method of this invention.

As seen in FIG. 2 a first groove 1 of a roll 0 has a triangular ridge 2 of an apex angle Al, a radius of curvature Rl, and a height El. Level with the apex of the ridge the width of the groove 1 is equal to the thickness BO (See FIG. 1.) of the bloom 4 plus several centimeters. Two factors decide how much wider the groove 2 should be than B0, namely, the groove width must be such that the notches formed in the bloom edges in the first two or three passes should be exactly centered and the flanks of the notches, that is the width of the bloom to each side of each notch, should be as thick as possible. In addition the shape of the groove should allow a perfectly vertical guiding of the bloom.

The bloom 4 is passed back and forth in the groove 1 normally two or three times, in accordance with bloom height H0, until it engages the base of this groove 1, thereby ensuring a notch of maximum depth. Rolling in the groove 1 should not generally be done for more than three passes because of the danger of lateral spillover as well as unneeded lengthening of the edges of the bloom forming fishtails at the ends.

The second "groove" is mainly formed by a raised part 6 formed in between the first groove 1 and the third groove 7. The ridge 5 machined in this raised part 6 has an apex angle A2 and a radius R2 greater than Al and Rl, respectively.

The two passes done in this second "groove" 6 serve to enlarge and to deepen the notch formed at the first groove 1. At the same time the radius at the base of the notch Rl is increased to R2. The shape of this groove, characterized by the absence of external faces, allows the flanks of the notch to spread freely. It is necessary to note that during this phase of rolling one does not encounter problems of instability even though the bloom is only held by ridges.

There follows two passes in the third groove 7 serving basically to open the notch to an angle A3 greater than the angle A2, the radius at the base of the notch increasing from R2 to R3. It is noted that the ridge 8, of apex angle A3 and radius R3, has in general the same height measured radially of the respective roll axis as the ridge 2 of the first groove.

Most of the notch is eliminated in the breakdown passes of the fourth groove 9. These breakdown passes and the width of the groove are chosen as a function of the width and the thickness of the flanges of the beam being rolled. The slight bump 10 serves mainly for centering and is not essential.

The intermediate blank obtained is then rolled into a beam blank in several roughing passes and several intermediate passes as is known. The corresponding grooves are normally on the same pair of rolls. The blank is then sent to the finishing train.

We claim:

1. A method of rolling an I-beam blank from a bloom, comprising the steps of:

(a) forming peripheries of a pair of rolling-mill rolls each with a plurality of axially spaced grooves forming respective pairs cooperating to shape opposite flange edges of a bloom fed between said rolls, respective triangular-section ridges rising from a base of each groove and having different apex angles and rounded apexes of different radii, the apex radii increasing with increasing apex angle of said ridges, a further triangular-section ridge projecting from each periphery between two of said grooves therein;

(b) rolling with said rolls into opposite edges of said bloom respective central triangular-section notches in at least one pass for each of said ridges rising from a base of a respective groove and until the respective edge of said bloom bottoms on the respective base, and for said further ridge whereby the formation of said notches by at least one of said ridges involves unconfined spread of material of the bloom at the respective edge;

(c) sequencing the rolling of said triangular-section notches into said edges by said ridges so that the radius and apex angle of the notches are progressively increased from ridge to ridge; and (d) thereafter pressing said notches generally out of and generally flattening the bloom edges in at least one final rolling pass between said rolls and in ridge-free grooves formed therein.

2. The method defined in claim 1 wherein said further ridge is so positioned that the material of an edge of said bloom spread by said futher ridge overhangs a pair of said grooves in the respective periphery.

3. The method defined in claim 2 wherein said ridges roll said notches to substantially the same depth in said edges.

* * * * *